US012590757B2

(12) United States Patent
Aoun et al.

(10) Patent No.: US 12,590,757 B2
(45) Date of Patent: Mar. 31, 2026

(54) METHOD FOR COOLING A HEAT EXCHANGER OF A GAS SUPPLY SYSTEM FOR A GAS-CONSUMING APPARATUS OF A SHIP

(71) Applicant: GAZTRANSPORT ET TECHNIGAZ, Saint Remy les Chevreuse (FR)

(72) Inventors: Bernard Aoun, Saint Remy les Chevreuse (FR); Romain Narme, Saint Remy les Chevreuse (FR); Selma Moussaoui, Saint Remy les Chevreuse (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 230 days.

(21) Appl. No.: 18/552,766

(22) PCT Filed: Mar. 24, 2022

(86) PCT No.: PCT/FR2022/050552
§ 371 (c)(1),
(2) Date: Sep. 27, 2023

(87) PCT Pub. No.: WO2022/208003
PCT Pub. Date: Oct. 6, 2022

(65) Prior Publication Data

US 2024/0159460 A1 May 16, 2024

(30) Foreign Application Priority Data

Apr. 1, 2021 (FR) ..... 2103393

(51) Int. Cl.
*F25J 1/00* (2006.01)
*F25J 1/02* (2006.01)

(52) U.S. Cl.
CPC ..... *F25J 1/0025* (2013.01); *F25J 1/0035* (2013.01); *F25J 1/0045* (2013.01); *F25J 1/0277* (2013.01)

(58) Field of Classification Search
CPC ..... B63B 11/04; B63B 25/16; B63B 27/24; B63B 27/34; F25J 1/0025; F25J 1/0035;
(Continued)

(56) References Cited

U.S. PATENT DOCUMENTS 3,962,881 A * 6/1976 Muska ..... F17C 9/04 62/121
4,266,958 A * 5/1981 Cummings ..... C07C 7/00 62/47.1
(Continued)

FOREIGN PATENT DOCUMENTS

DE 10 2009 042 994 A1 3/2011
EP 3 594 596 A1 1/2020
(Continued)

OTHER PUBLICATIONS

Machine translation of WO 2020109607 (Year: 2020).*
(Continued)

*Primary Examiner* — Filip Zec
(74) *Attorney, Agent, or Firm* — Oblon, McClelland, Maier & Neustadt, L.L.P.

(57) ABSTRACT

A method for supplying gas to a gas-consuming apparatus provided on a ship including a tank containing the gas in the liquid state and in the gaseous state, in which the method includes: supplying the gas-consuming apparatus with gas withdrawn in the gaseous state from the tank and by a supply unit; condensing at least a part of the gas withdrawn in the gaseous state from the tank by a condensation unit having at least one heat exchanger configured to perform a heat exchange between gas withdrawn between the supply unit
(Continued)

Figure 1:
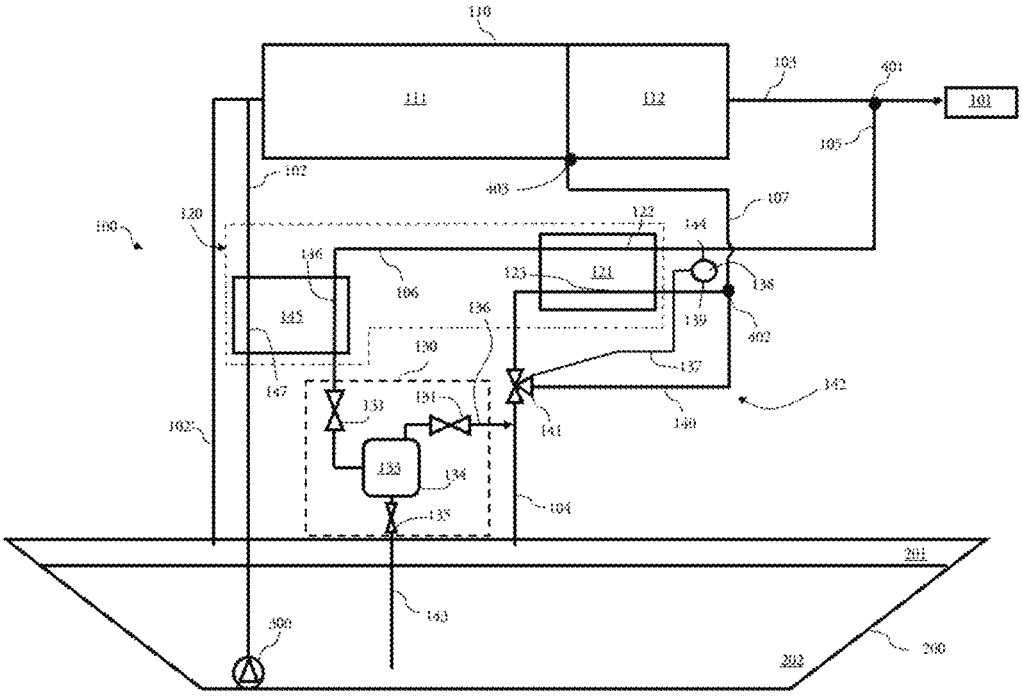

and the gas-consuming apparatus and gas flowing between the tank and the supply unit; and cooling the heat exchanger prior to the condensing and at least partially simultaneously with the supplying.

18 Claims, 5 Drawing Sheets

(58) Field of Classification Search
CPC ..... F25J 1/004; F25J 1/0045; F25J 1/0052; F25J 1/0202; F25J 1/0208; F25J 1/023; F25J 1/0245; F25J 1/0247; F25J 1/0248; F25J 1/0265; F25J 1/0277; F25J 1/0294; F25J 2245/02; F25J 2290/34; F17C 2221/033; F17C 2223/0161; F17C 2223/033; F17C 2223/043; F17C 2223/047; F17C 2225/0123; F17C 2225/033; F17C 2225/035; F17C 2227/0135; F17C 2227/0178; F17C 2227/0306; F17C 2227/0309; F17C 2227/0323; F17C 2227/0393; F17C 2260/046; F17C 2265/033; F17C 2265/036; F17C 2265/066; F17C 2265/07; F17C 2270/0105; F17C 9/04
See application file for complete search history.

(56) References Cited

U.S. PATENT DOCUMENTS

| | | | | |
|---|---|---|---|---|
| 9,739,420 | B2 * | 8/2017 | Lee | F17C 7/04 |
| 10,168,000 | B2 * | 1/2019 | Harrington | F04B 53/14 |
| 10,801,775 | B2 * | 10/2020 | Ragot | F25J 1/004 |
| 10,816,140 | B2 * | 10/2020 | De Nardis | F17C 7/04 |
| 10,858,077 | B2 * | 12/2020 | Lee | F17C 7/04 |
| 11,242,123 | B2 * | 2/2022 | Shin | F25J 1/0294 |
| 11,512,402 | B2 * | 11/2022 | Bairamijamal | C07C 41/01 |
| 2012/0222430 | A1 * | 9/2012 | Madsen | F17C 7/04 62/48.1 |
| 2015/0219280 | A1 * | 8/2015 | Braithwaite | F17C 3/00 62/48.3 |
| 2016/0114876 | A1 * | 4/2016 | Lee | F17C 7/04 62/48.1 |
| 2017/0067685 | A1 * | 3/2017 | Lee | F02M 21/0287 |
| 2021/0148513 | A1 | 5/2021 | Lee et al. | |
| 2021/0164728 | A1 * | 6/2021 | Borisevich | F17C 13/004 |

FOREIGN PATENT DOCUMENTS

| | | | |
|---|---|---|---|
| EP | 3 663 184 | A1 | 6/2020 |
| WO | WO 2020/0109607 | A1 | 6/2020 |
| WO | WO 2021/032925 | A1 | 2/2021 |

OTHER PUBLICATIONS

Machine Translation of WO 2021032925 (Year: 2021).*
International Search Report Issued Jul. 11, 2022, in PCT/FR2022/050552, filed on Mar. 24, 2022, 2 pages.

* cited by examiner

METHOD FOR COOLING A HEAT EXCHANGER OF A GAS SUPPLY SYSTEM FOR A GAS-CONSUMING APPARATUS OF A SHIP

The present invention relates to the field of ships whose propulsion engines are powered by natural gas and which also make it possible to contain and/or transport liquefied natural gas.

Such ships thus conventionally comprise tanks that contain natural gas in the liquid state. Natural gas is liquid at temperatures below −160° C. at atmospheric pressure. These tanks are never perfectly thermally insulated so that the natural gas at least partially evaporates therein. Thus, these tanks comprise both natural gas in liquid form and natural gas in gaseous form. This natural gas in gaseous form forms the top of the tank and the pressure in this top of the tank has to be controlled so as not to damage the tank. In a known manner, at least a part of the natural gas present in the tank in the gaseous form is thus used to power, inter alia, the propulsion engines of the ship.

Nonetheless, when the ship is at stop, the consumption of natural gas by these engines is zero, or almost zero, the natural gas present in the gaseous state in the tank being no longer consumed by these engines. Thus, reliquefaction systems which make it possible to condense the evaporated natural gas present in the tank are implemented on the ship, in order to return it to this tank, in the liquid state.

The reliquefaction systems currently used require a preparation of the unit which is very expensive in terms of energy. Indeed, the temperature of the system, in particular heat exchangers used for the treatment of the gas, must be brought to a value lower than a threshold value from which the reliquefaction could start. It should be understood that this delay increases the time to put the reliquefaction system into action, such a delay also being a particularly energy-extensive time period. The present invention falls within this context by providing a method for supplying gas to a gas-consuming apparatus which comprises a condensation unit responsible for liquefying the gas, at least one heat exchanger of this condensation unit being cooled to reduce the operating time of the condensation unit.

Thus, an object of the present invention relates to a method for supplying gas to a gas-consuming apparatus provided on a ship comprising a tank containing the gas in the liquid state and in the gaseous state, the method comprising at least:

- a step of supplying the gas-consuming apparatus with gas withdrawn in the gaseous state from the tank and by means of a supply unit,
- a step of condensing at least a part of the gas withdrawn in the gaseous state from the tank by means of a condensation unit comprising at least one heat exchanger configured to perform a heat exchange between gas withdrawn between the supply unit and the gas-consuming apparatus and gas flowing between the tank and the supply unit, the method being characterized in that it comprises a step of cooling the heat exchanger, this cooling step being implemented prior to the condensation step and at least partially simultaneously with the supply step.

In contrast with the prior art, the method enables a gas flow in the heat exchanger even if the gas-consuming apparatus consumes the gas in the vapor state available in a headspace of the tank. This flow is controlled and it is particularly low compared to the flow rates of the rest of the system, so as not to unbalance the latter.

Such an organization makes it possible to cool, in particular to keep, the heat exchanger at a low temperature, close to its operating conditions when it carries out the condensation step. Thus, the amount of energy consumed and/or the time of activation of the condensation unit is very significantly reduced, which makes it possible to maximize the amount of liquefied gas and consequently to minimize its loss.

According to one feature of the invention, the cooling step comprises control of a flow rate of gas flowing through a first pass of the heat exchanger to a ratio comprised between 2% and 12% of a flow rate of the gas withdrawn in the gaseous state from the tank during the supply step. For example, when the flow rate of gas in the vapor state that leaves the tank is 2,500 kg/h, the flow rate of gas that cools the heat exchanger is comprised between 50 kg/h and 300 kg/h.

According to another feature of the invention, the cooling step comprises control of a flow rate of gas flowing through a second pass of the heat exchanger during the cooling step to a ratio comprised between 75% and 135% of a flow rate of the gas flowing through a first pass of the heat exchanger. Preferably, this ratio is equal to 115%, which guarantees optimal cooling. Such ratio values have the effect of controlling the heat exchange between the two passes of the heat exchanger to avoid generating thermal stresses that might damage it. Thus, it is possible to use an aluminum plate exchanger technology, much more affordable than that of the prior art.

According to one feature of the method, the cooling step comprises control of a flow rate of gas flowing through a first pass of the heat exchanger during the cooling step to a value comprised between 50 kg/h and 300 kg/h. These flow rate values guarantee that the cooling step does not negatively affect the step of supplying the gas consumer, while ensuring that only a marginal portion of the flow rate of gas sent to the consumer is withdrawn, while setting, or keeping, the heat exchanger at a low temperature, for a quick action of the condensation unit.

It should be noted that a flow rate of gas flowing through a first pass of the heat exchanger during the cooling step is comprised between 3% and 20% of a flow rate of gas flowing through the first pass of the heat exchanger during the condensation step. This makes it possible to distinguish a cooling step compared to a condensation step.

Advantageously, the gas that flows through the first pass of the heat exchanger during the cooling step joins the supply unit. Thus, this gas which has cooled the heat exchanger is mixed with the gas coming from the tank and which is sent to the supply unit.

According to one feature, the step of cooling the heat exchanger is a step of cooling this heat exchanger leading to making the heat exchanger pass from a positive Celsius temperature down to a negative Celsius temperature. For example, the temperature of the heat exchanger passes from +42° Celsius to −117° Celsius, in particular while preserving a maximum temperature difference between the first pass and the second pass of 27°.

According to another feature, the step of cooling the heat exchanger is a step of keeping this heat exchanger cold leading to the heat exchanger passing from a first negative Celsius temperature to a second negative Celsius temperature. According to one example, the first temperature may be equal to the second temperature, which leads to keeping the heat exchanger at a temperature of −120° Celsius for example, such that the latter is immediately available to implement the condensation step. According to another example, the first temperature, for example −117° Celsius, is higher than the second temperature, for example −120° Celsius.

It should be noted that the cold holding step is preceded by a condensation step. In other words, the cold holding step is chronologically interposed between two condensation steps. Such a choice facilitates keeping the heat exchanger cold because the beginning of the cold holding step occurs in a situation where the exchanger is at a very low temperature, at the end of the condensation phase.

The present invention also relates to a system for supplying gas to at least one gas-consuming apparatus, the system comprising at least:

- a tank for storing and/or transporting gas in the liquid state and in the gaseous state, intended to contain gas,
- a supply unit for the gas-consuming apparatus configured to withdraw gas from the tank and raise its pressure to supply the gas-consuming apparatus,
- a condensation unit comprising at least one heat exchanger which includes a first pass and a second pass, the condensation unit being configured so that the gas withdrawn between the supply unit and the gas-consuming apparatus flows through the first pass, whereas the gas flowing between the tank and the supply unit flows through the second pass,
- a device for cooling the heat exchanger comprising at least one control member configured to control the flow rate of the gas flowing through the first pass and a device for controlling the temperature of the heat exchanger.

The first pass is arranged between the tank and the supply unit and the second pass is arranged between the supply unit and the tank, in that order according to the respective flow directions of the gas in the first pass and in the second pass of the heat exchanger.

According to an embodiment of the invention, the control member regulates the flow rate flowing through the first pass. For example, this flow rate control member may be in the form of a valve adapted to assume at least one open position, a closed position and a plurality of intermediate positions which make it possible to control the flow rate of the gas intended to supply the heat exchanger at least during the cooling step.

According to a feature of the system, the control member is configured to control the flow rate of gas flowing through the first pass to a value comprised between 50 kg/h and 300 kg/h. Thus, this control member is designed to finely control a gas flow rate within a pipe, such a flow rate nevertheless being significantly lower than the flow rate used by the condensation step when the system is in the liquefaction mode.

According to a feature of the invention, the device for controlling the temperature of the heat exchanger comprises at least one duct for bypassing the second pass of the heat exchanger. Thus, it is possible to control the flow rate of gas flowing through the second pass compared to that flowing through the bypass duct and thus act on the heat exchange that takes place between the first pass and the second pass of this heat exchanger.

According to another feature, the device for controlling the temperature of the heat exchanger comprises at least one member for managing a flow rate of gas flowing through the bypass duct, the flow rate of gas flowing through the bypass duct depending at least on a temperature of the gas determined at the inlet of the first pass of the heat exchanger. In other words, this at least one bypass duct extends between the tank and the supply unit, in parallel with the second pass of the heat exchanger.

Complementarily, the flow rate of gas flowing through the bypass duct depends on a temperature of the gas determined at the outlet of the second pass of the heat exchanger.

These arrangements aim to control the temperature of the gas flowing through the first pass and the second pass, so as to avoid any mechanical stress that would result from an excessive temperature difference between the first pass and the second pass of the heat exchanger.

According to an aspect of the invention, the condensation unit comprising at least the heat exchanger, hereinafter referred to as the first heat exchanger, which includes the first pass and the second pass, also comprises a second heat exchanger which is the site of a heat exchange between gas withdrawn in the liquid state from the tank and the gas coming from the first pass of the first heat exchanger.

The first heat exchanger is that described hereinabove, i.e. the heat exchanger that includes a first pass and a second pass, the condensation unit being configured so that the gas withdrawn between the supply unit and the gas-consuming apparatus flows through the first pass, whereas the gas flowing between the tank and the supply unit flows through the second pass.

The second heat exchanger is downstream of the first heat exchanger, with respect to the gas flow withdrawn between the supply unit and the consumer apparatus. This second heat exchanger is arranged upstream of the cooling device, according to the flow direction of this same gas flow.

According to an aspect of the system, the supply unit comprises at least one portion for raising the temperature of gas withdrawn in the liquid state from the tank and at least one portion for raising the pressure of the gas to supply the gas-consuming apparatus.

In order to raise this gas pressure to supply the gas-consuming apparatus, the supply unit comprises at least one compression member. Advantageously, the supply unit may comprise two compression members so as to ensure redundancy, i.e., if one of the two compression members becomes defective, the other compression member can replace it. According to the invention, the supply unit is configured to raise the pressure of the gas to a pressure compatible with the needs of the gas-consuming apparatus. For example, the gas may be high at a pressure comprised between 1 bar and 400 bar, advantageously between 1 bar and 17 bar, still more advantageously between 6 bar and 17 bar.

According to a feature of this embodiment, the temperature raising portion of the supply unit may for example comprise at least one heat exchanger and at least one compression device, the compression device being arranged between the heat exchanger and the gas pressure raising portion, the heat exchanger comprising at least one first line supplied by gas withdrawn in the liquid state from the tank and at least one second line supplied by gas withdrawn in the liquid state from the tank, at least one expansion device being arranged between the tank and the first line of the heat exchanger.

According to this embodiment, the temperature raising portion thus forms a gas evaporation portion, i.e. the gas that is withdrawn from the tank in the liquid state is heated so as to pass into the gaseous state before joining the pressure raising portion of the supply unit.

The invention also relates to a liquid gas transport ship, comprising at least one gas supply system according to any one of the features disclosed hereinabove, the tank, the supply unit, the condensation unit and the cooling device being carried by the ship.

The invention also relates to a system for loading or unloading a liquid gas which combines at least one onshore or port facility and at least one ship for transporting liquid gas as mentioned hereinabove.

Finally, the invention relates to a method for loading or unloading a liquid gas for a gas transport ship as mentioned hereinabove, during which the gas in the liquid state is conveyed through the pipes from or towards a floating or onshore storage facility towards or from the tank of the ship.

Figure 2:
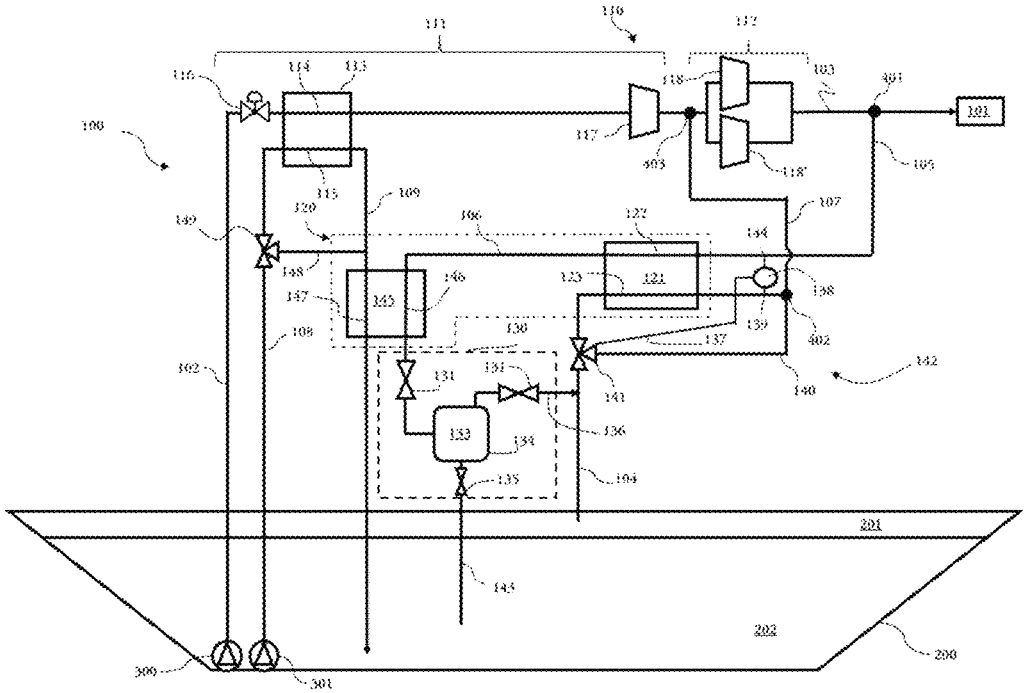
Figure 3:
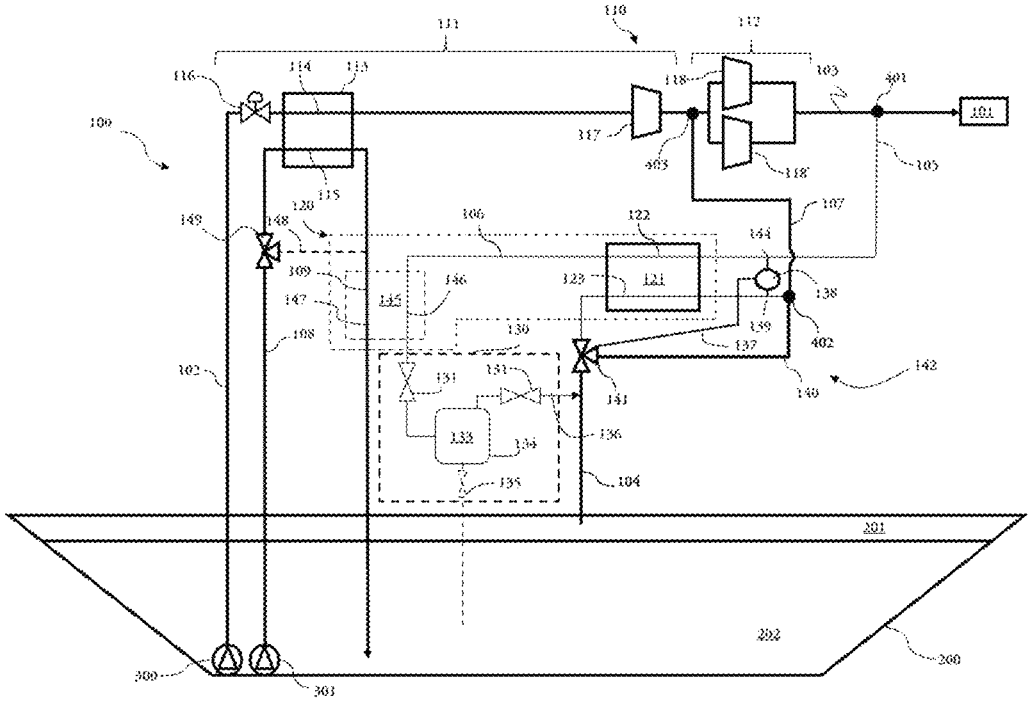
Figure 4:
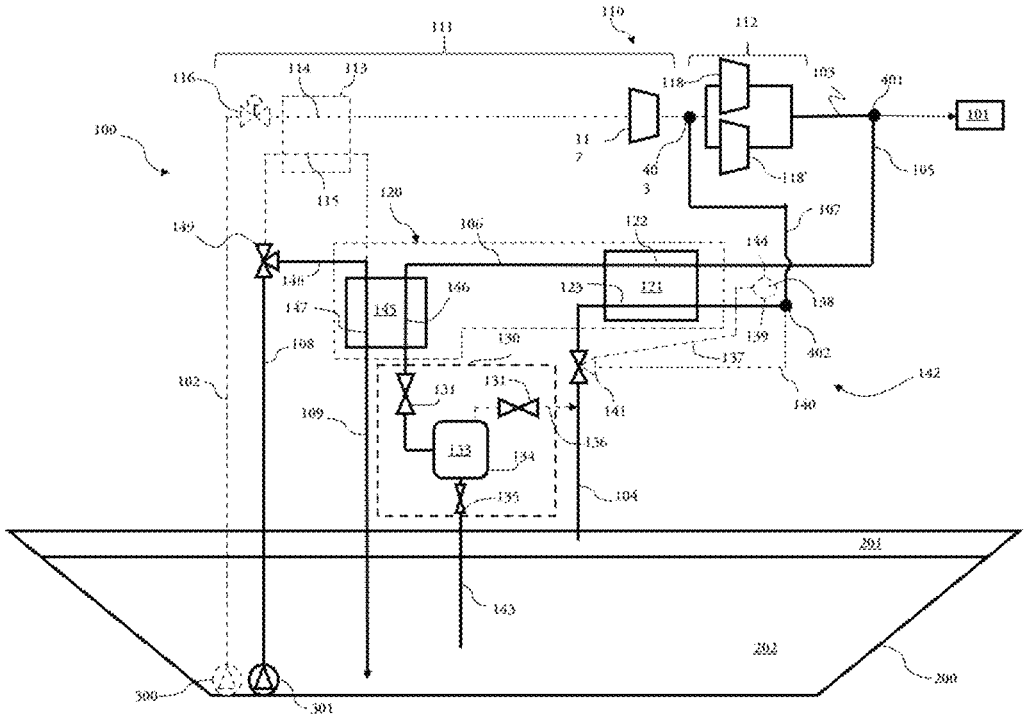
Figure 5:
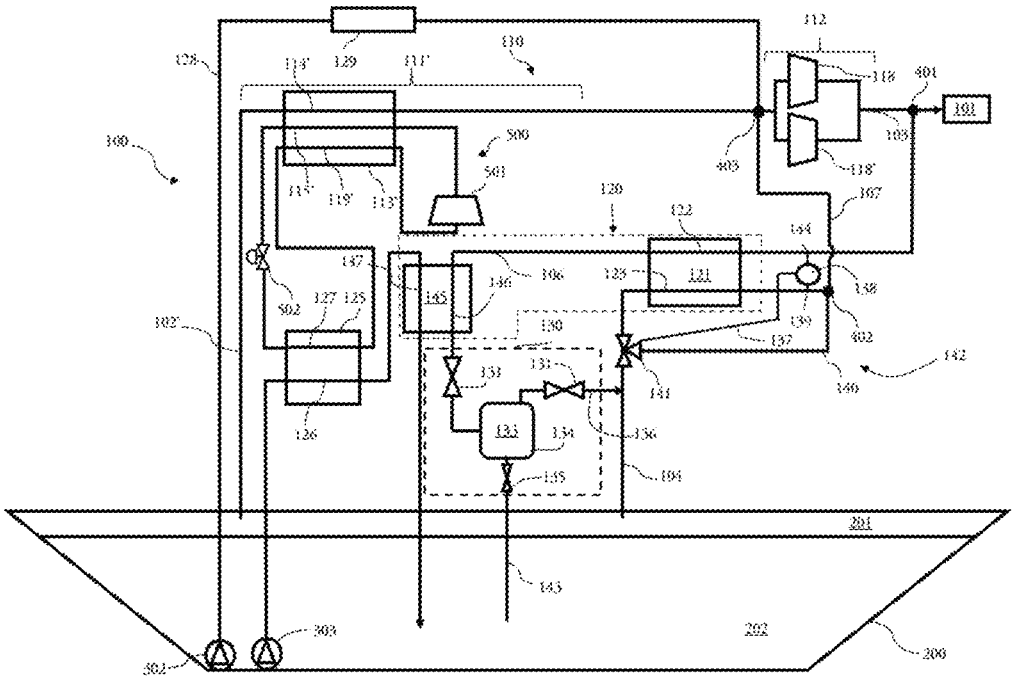
Figure 6:
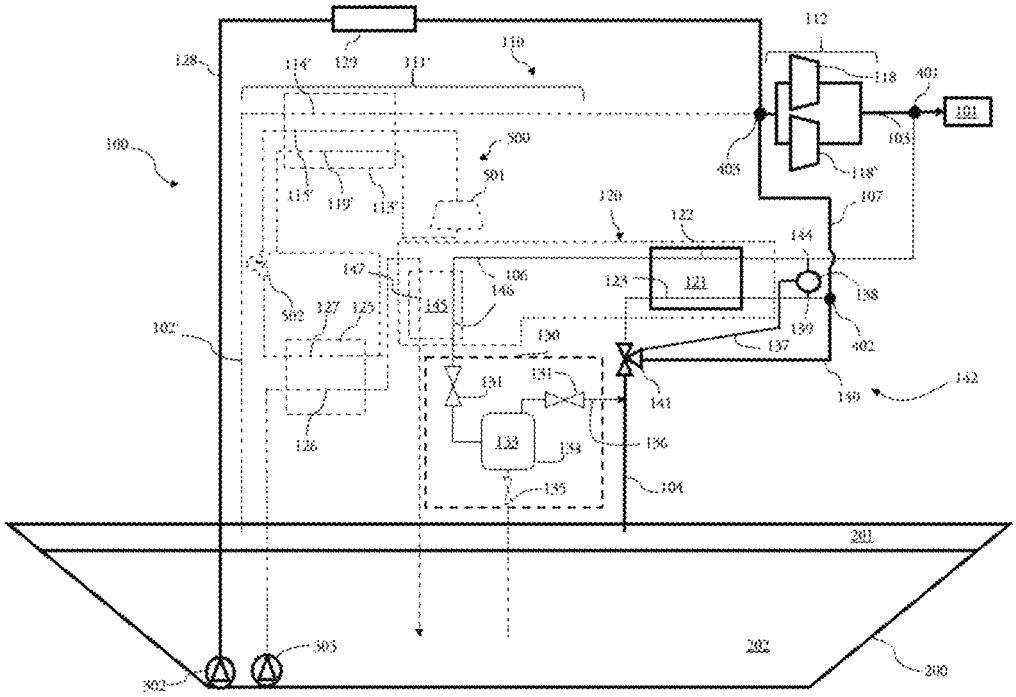
Figure 7:
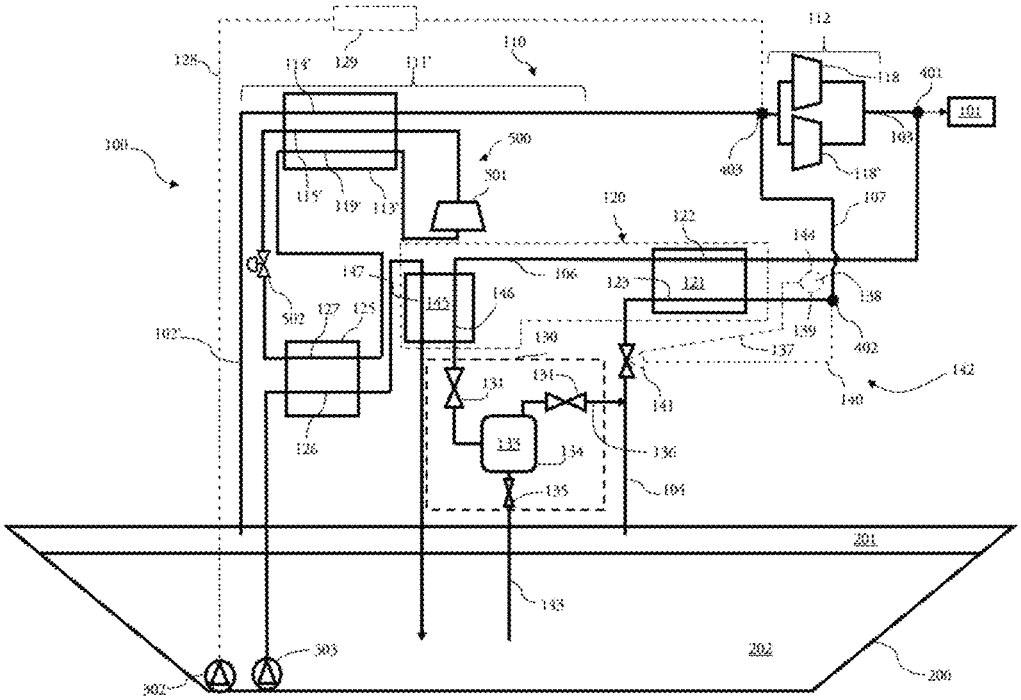
Figure 8:
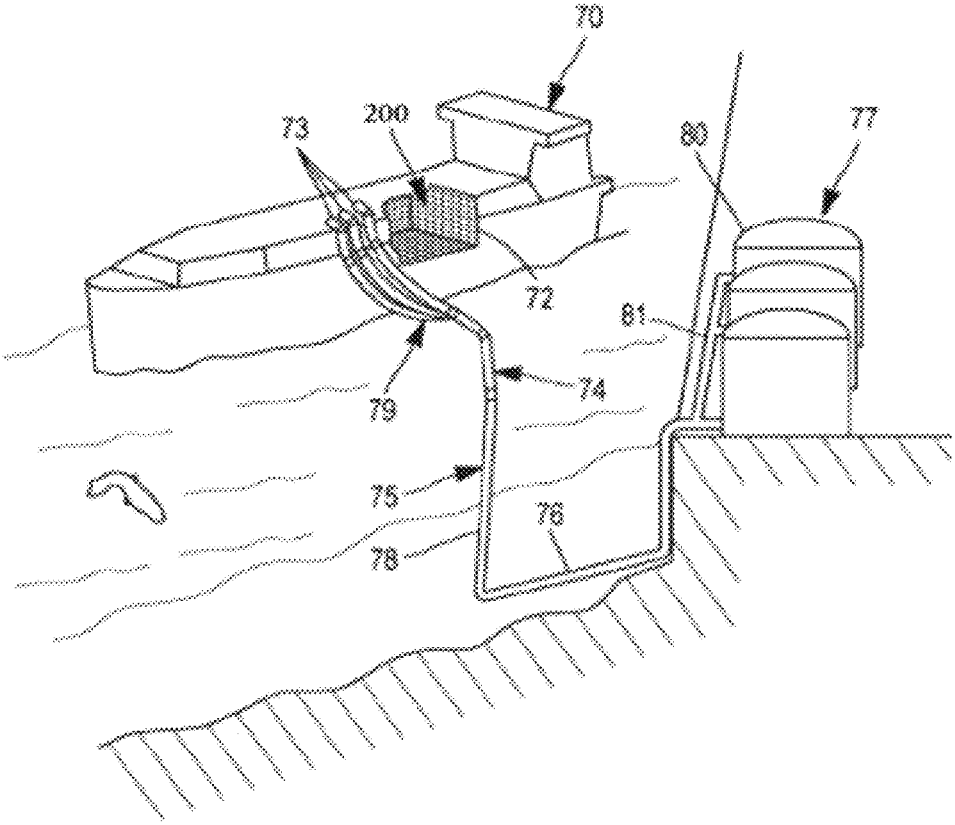

Other features, details and advantages of the invention will appear more clearly upon reading the following description on the one hand and from an embodiment given for illustrative purposes and without limitation with reference to the appended drawings on the other hand, wherein:

FIG. 1 schematically illustrates a gas supply system for a gas-consuming apparatus according to the present invention;

FIG. 2 schematically illustrates a first embodiment of the gas supply system illustrated in FIG. 1;

FIG. 3 schematically illustrates an implementation of the gas supply system illustrated in FIG. 2, according to a temperature holding mode;

FIG. 4 schematically illustrates an implementation of the gas supply system illustrated in FIG. 2, according to a condensation mode;

FIG. 5 schematically illustrates a second embodiment of the gas supply system according to the invention;

FIG. 6 schematically illustrates an implementation of the gas supply system illustrated in FIG. 5, according to a temperature holding mode;

FIG. 7 schematically illustrates an implementation of the gas supply system illustrates in FIG. 5, according to a condensation mode;

FIG. 8 is a cut-away schematic illustration of an LNG ship tank and of a terminal for loading and/or unloading this tank.

In the remainder of the description, the terms "upstream" and "downstream" should be understood according to a direction of flow of a gas in the liquid, gaseous or two-phase state through the considered element. In FIGS. 3, 4, 6 and 7, the broken lines represent circuit ducts in which no gas flows, whereas the solid lines represent circuit ducts in which the gas flows, regardless of the state of this gas. Also, the thickness of the lines is proportional to the flow rate of the gas flowing in the corresponding duct. Thus, the thinnest lines represent ducts in which the gas flows at a first flow rate comprised between 50 kg/h and 300 kg/h and the thicker lines represent ducts in which the gas flows at a second flow rate strictly higher than 300 kg/h.

In the present document, the terms "liquefaction" and "condensation" are used without distinction.

FIGS. 1 to 7 illustrate a gas supply system 100 of at least one gas-consuming apparatus 101. As shown, the system 100 comprises at least one tank 200 which contains the gas intended to be supplied to the at least one gas-consuming apparatus 101, the gas being contained in this tank 200 in the liquid state and in the gaseous state. In the following description, the space of the tank 200 occupied by the gas in the gaseous state is called "tank headspace 201" and the space of the tank 200 occupied by the gas in the liquid state is called "bottom of the tank 202".

The following description gives a particular example of application of the present invention wherein the tank 200 contains natural gas. It should be understood that this is only an example of application and that the gas supply system 100 according to the invention can be used with different types of gases, for example hydrocarbon or hydrogen gases. Likewise, the figures illustrate systems for supplying gas to one or two fuel-consuming apparatuses, but it should be understood that the system could be suitable for supplying more than two gas-consuming apparatuses without departing from the context of the invention. In the remainder of the description, unless stated otherwise, the terms "gas-consuming apparatus" designate one or more gas-consuming apparatuses.

Thus, FIG. 1 schematically illustrates, primarily, the gas supply system 100 of the gas-consuming apparatus 101, when stopped, i.e. when no gas, whether in the gaseous, liquid or two-phase state, flows.

According to the invention, the system 100 comprises at least the aforementioned tank 200, a supply unit 110 of the at least one gas-consuming apparatus 101, a gas condensation unit 120, the gas-consuming apparatus 101 and a cooling device 130.

As schematically shown, at least a first duct 102, 102' is arranged between the tank 200 and the supply unit 110. According to the invention, the supply unit 110 can be supplied by gas withdrawn in the gaseous state from the tank headspace 201 or by gas withdrawn in the liquid state from the tank 200. In other words, the first duct 102' may extend between the tank headspace 201 and the supply unit 110, or this first duct 102 can extend between the bottom of the tank 202 and the supply unit 110, and more particularly between a pump 300 arranged in the bottom of the tank 202 and the supply unit 110.

Regardless of the state of the gas that supplies the supply unit 110, the latter comprises at least one temperature raising portion 111 configured to increase the temperature of the gas withdrawn from the tank 200 so that this gas leaves the supply unit 110 in the gaseous state and at a temperature compatible with the needs of the gas-consuming apparatus 101. The supply unit 110 also comprises at least one pressure raising portion 112 configured to raise the pressure of this gas up to a pressure compatible with the needs of the gas-consuming apparatus 101. As detailed below, the temperature raising portion 111 comprises at least one heat exchanger and the pressure raising portion 112 comprises at least one compression member.

The system 100 comprises at least one second duct 103 which connects the supply unit 110 to the gas-consuming apparatus 101. It should be understood from the foregoing that gas in the gaseous state which has a temperature and a pressure compatible with the needs of the gas-consuming apparatus 101 flows through this second duct 103.

According to the invention, the pressure raising portion 112 comprises at least one compression member 118—for example shown in FIGS. 2 to 7—configured to raise the pressure of the gas that passes therethrough to the pressure compatible with the needs of the gas-consuming apparatus 101. According to any one of the embodiments described hereinafter, the pressure raising unit 112 comprises more particularly a first compression member 118 and a second compression member 118' installed parallel to one another.

According to different examples of application of the present invention, provision may be made for only the first compression member 118 to operate, the second compression member 118' then ensuring redundancy, i.e. this second compression member 118' then makes it possible to replace the first compression member 118 if the latter were to fail. Alternatively, it can be provided that the first compression member 118 and the second compression member 118' operate simultaneously, i.e. a first portion of the gas coming from the pressure raising portion 111 is compressed by the first compression member 118 and that a second portion of this gas is, in turn, compressed by the second compression member 118', this first portion and this second portion of the gas being distinct. Each of these compression members 118, 118' is also connected to the second duct 103, itself connected to the gas-consuming apparatus 101.

According to any one of these examples of application, the gas joins the first compression member 118 and/or the second compression member 118' in the gaseous state and at a pressure of about 1 bar and this gas leaves the first compression member 118 and/or the second compression member 118' in the gaseous state and at high pressure, i.e., a pressure comprised between 1 bar and 400 bar, advantageously between 1 bar and 17 bar, still more advantageously between 6 bar and 17 bar. The compression level at the outlet of this first compression member 118 and/or of this second compression member 118' is parameterized depending on the type of gas-consuming apparatus 101 to be supplied.

In turn, the condensation unit 120 comprises at least one heat exchanger 121 adapted to perform a heat exchange between gas withdrawn between the supply unit 110 and the gas-consuming apparatus 101 and the gas flowing between the tank 200 and the supply unit 110. More particularly, the heat exchanger 121 comprises at least one first pass 122 supplied by gas withdrawn between the supply unit 110 and the gas-consuming apparatus 101, i.e. gas compressed by the pressure raising portion 112, and at least one second pass 123 supplied by gas flowing between the tank headspace 201 and the pressure raising portion 112 of the supply unit 110.

Advantageously, the condensation unit 120 comprises another heat exchanger, hereinafter referred to as the second heat exchanger 145, when the above-described heat exchanger 121 is referred to as the first heat exchanger. The second heat exchanger 145 is used as a condenser during the implementation of the condensation step. This second heat exchanger 145 comprises a first pass 146 through which the gas withdrawn between the supply unit 110 and the gas-consuming apparatus 101 flows and a second pass 147 through which the gas withdrawn in the liquid state from the tank 200 flows.

The first pass 146 of the second heat exchanger 145 is arranged downstream of the first pass 122 of the first heat exchanger 121. The second pass 147 of the second heat exchanger 145 is arranged upstream of the supply unit 110.

The second heat exchanger 145 is the site of a heat exchange between the gas in the liquid state at a temperature at most equal to −163° C. and the gas in the vapor state withdrawn at the outlet of the supply unit 110, the latter being able to be at a positive temperature after passage thereof into the first pass 122 of the first heat exchanger 121.

The first heat exchanger 121 associated with the second heat exchanger 145 forms an embodiment of the condensation unit 120.

In the following description, the heat exchanger is the above-described first heat exchanger.

As shown, at least one third duct 104 thus extends between the tank headspace 201 and the second pass 123 of the heat exchanger 121 and at least one fourth duct 105 extends between the second duct 103 and the first pass 122, and more particularly this fourth duct 105 extends between a first connection point 401 located on this second duct 103 and an inlet of the first pass 122 of the heat exchanger 121.

Moreover, the first pass 122 is connected to the bottom of the tank 202 via a pipe 143 and the second pass 123 is connected to the supply unit 110 via a ninth duct 136 and by a sixth duct 107.

The heat exchanger 121 of the condensation unit 120 is configured to perform a heat exchange between gas withdrawn in the gaseous state from the tank headspace 201 and gas withdrawn downstream of the supply unit 110, i.e. gas in the gaseous state and having a temperature and pressure compatible with the needs of the gas-consuming apparatus 101. In other words, the heat exchanger 121 is configured to perform a heat exchange between gas withdrawn in the gaseous state from the tank headspace 201 and sent directly into the heat exchanger 121 and gas withdrawn in the gaseous state from the tank headspace 201 and whose pressure has been raised by the pressure raising portion 112 of the supply unit 110. By "sent directly in the heat exchanger 121", it should be understood that the natural gas withdrawn in the gaseous state does not undergo any modification of pressure or temperature, other than that related to its flow in the considered duct, before joining the heat exchanger 121, and more particularly the second pass 123 of this heat exchanger 110.

The result of this heat exchange is at least cooling of the gas flowing in the first pass 122 of the heat exchanger 121 and a rise in the temperature of the gas flowing in the second pass 123 of this heat exchanger 121.

According to the invention, the cooling device 130 of the heat exchanger 121 comprises at least one member 131 for controlling a gas flow that flows in the first pass 122 of the heat exchanger 121. The cooling device 130 also comprises at least one phase separator 133, which has a two-phase inlet connected to an outlet of the first pass 122, a gas outlet connected to the third duct 104, upstream of the second pass 123 and a liquid outlet connected to the tank 200 by the pipe 143.

For example, the liquid phase of the gas contained in the phase separator 134 can be returned to the bottom of the tank 202 thanks to the pipe 143, the flow of this gas in the liquid state depending on a valve 135 installed on the pipe 143.

According to the invention, the heat exchanger 121 is cooled, in particular kept at low temperature, by a gas flow in the first pass 122 and in the second pass 123, yet without carrying out a condensation of this gas. This cooling of this heat exchanger 121 makes it possible to reach the condensation conditions of the gas more quickly when it is necessary to carry out this condensation.

As mentioned hereinabove, the cooling device 130 comprises at least the control member 131. "Control member" means any element capable of modifying the flow rate of gas within the duct that carries it. In this case, the control member 131 may be a valve adapted to assume at least one open position in which it enables the flow of gas, at least one closed position in which it prevents the flow of gas and a plurality of intermediate positions which make it possible to control the flow rate of the gas flowing in the first pass 122.

As illustrated in FIGS. 1 to 7, this control member 131 may be arranged on the fifth duct 106, upstream of the two-phase inlet of the phase separator 133. Alternatively or complementarily, this control member 131 may be arranged on a sixth duct 107 which extends between the gas outlet of the phase separator 133 and the third duct 104. In any case, this control member 131 is arranged on a duct that directly affects the flow rate of gas flowing through the first pass 122 of the heat exchanger 121, in particular upstream or downstream of the latter.

The supply system 100 according to the invention is configured to implement a step of cooling the heat exchanger 121 of the condensation unit 120. For example, this cooling step is controlled by the cooling device 130. As detailed hereinafter, this method enables a simultaneous supply of gas to the gas-consuming apparatus 101 and to the heat exchanger 121, with a reduced gas flow rate but nevertheless enough to cool, or keep this heat exchanger 121 at a temperature which enables operation in a reduced time of the condensation unit 120.

This step of cooling the heat exchanger 121 is performed chronologically before the condensation step, since it is intended to thermally prepare this heat exchanger in order to perform a liquefaction, and simultaneously with the supply step, such that this cooling is transparent from an energy perspective.

The cooling device 130 according to the invention is configured to derive a portion of the gas intended for supplying the gas-consuming apparatus 101 in order to cool or keep at low temperature the heat exchanger 121 of the condensation unit 120. In other words, the control member 131 is configured to assume one of the aforementioned intermediate positions, which makes it possible to obtain a flow rate, within the fifth duct 106, comprised between 50 kg/h and 300 kg/h. Advantageously, the control member 131 is configured to assume an intermediate position thanks to which the gas flowing in the fourth duct 105 has a flow rate equal, or substantially equal, to 200 kg/h.

In order to avoid any thermal shocks within the heat exchanger 121, the cooling device 130 comprises a device 142 for controlling the temperature of the heat exchanger 121. As shown, this device 142 for controlling the temperature of the heat exchanger 121 includes at least one duct 140 for bypassing the second pass 123 of this heat exchanger 121.

As shown, this bypass duct 140 thus extends between the tank headspace 201 and the supply unit 110 and makes it possible to bypass the second pass 123 of the heat exchanger 121. More particularly, this bypass duct 140 is formed so that the gas that follows this bypass duct 140 joins the pressure raising portion 112. At least one flow regulation device 141 is arranged at the intersection between the third duct 104 and the bypass duct 140. According to the illustrated example, this flow rate regulation device 141 is a three-way valve adapted to assume at least one first open position in which it enables the flow of gas only in the bypass duct 140, at least one second open position in which it enables the flow of gas only in the direction of the second pass 123 of the heat exchanger 121 and a plurality of intermediate positions in which it enables the flow of gas in the bypass duct 140 and in the direction of the second pass 123 of the heat exchanger 121 at different flow rates, these flow rates being lower than the flow rate that the gas has when the flow rate regulation device 141 is in one of its open positions.

When the cooling step is implemented, the flow rate regulation device 141 is in an intermediate position in which it enables the flow of gas in the bypass duct 140 so that the gas flowing in the second pass 123 of the heat exchanger 121 of the condensation unit 120 has a flow rate comprised between 37.5 kg/h and 405 kg/h. Advantageously, this flow rate is equal, or substantially equal, to 230 kg/h. In general, the flow rate regulation device 141 controls the flow rate of gas flowing through the second pass 123 of the heat exchanger 121 to a ratio comprised between 75% and 135% of a flow rate of the gas flowing through the first pass 122 of the heat exchanger 121, this last flow rate being comprised between 50 kg/h and 300 kg/h.

It should be noted that the gas that leaves the second pass 123 of the heat exchanger 121 and the gas that flows in the bypass duct 140 join at a second connection point 402 from which the sixth duct 107 extends. Thus, the gas leaving the heat exchanger 121 and the gas leaving the bypass duct 140 are mixed upstream of the supply unit 110, and more particularly upstream of the pressure raising portion 112 of this supply unit 110. As shown, this sixth duct 107 extends between the second connection point 402 and a third connection point 403 located upstream of the pressure raising portion 112 of the supply unit 110, in particular between the temperature raising portion 111 and the pressure raising portion 112 of this supply unit 110.

In other words, the system 100 is configured so that the gas that leaves the second pass 123 of the heat exchanger 121 and the gas that flows in the bypass duct 140 jointly undergo the pressure rise imparted by the pressure raising portion 112 of the supply unit 110.

The flow rate of gas flowing through the bypass duct 140 depends on a temperature of the gas determined or measured at an inlet 144 of the first pass 122 of the heat exchanger 121. Thus, the position of the flow rate regulation device 141 is determined by the temperature of the gas measured at the inlet 144.

For example, the measurement or the determination of the temperature of the gas at the inlet 144 of the first pass 122 is carried out by means of a sensor 138, a probe of which may for example be in direct or indirect contact with the gas flowing in the considered pipe.

A control line 137 symbolizes the dependency of the flow rate regulation device 141 on the temperature of the gas measured at the inlet 144 by the sensor 138.

Such a sensor 138 and such a control line 137 may be part of the device 142 for controlling the temperature of the heat exchanger 121.

In addition, the flow rate of gas flowing through the bypass duct 140 also depends on a temperature of the gas determined or measured at an outlet 139 of the second pass 123 of the heat exchanger 121. Thus, the position of the flow rate regulation device 141 is also controlled by the temperature of the gas measured at the outlet 139.

For example, the measurement or the determination of the temperature of the gas at the outlet 139 of the second pass 123 is carried out by means of the aforementioned sensor 138, a probe of which could for example be in direct or indirect contact with the gas flowing in the considered duct. Of course, such a temperature may also be determined or measured by another sensor distinct from the sensor 138.

Herein again, the control line 137 symbolizes the dependency of the flow rate regulation device 141 on the temperature of the gas measured at the outlet 139 by the sensor 138.

Referring to FIGS. 2 to 4, a first embodiment of the invention will be described, FIG. 2 illustrating the system 100 when stopped, FIG. 3 illustrating the system 100 where the heat exchanger 121 is cooled, in particular kept cold by the method according to the invention and FIG. 4 illustrating the system 100 used during a condensation phase.

Referring to FIGS. 5 to 7, a second embodiment of the invention is described, FIG. 5 illustrating the system 100 when stopped, FIG. 6 illustrating the system 100 where the heat exchanger 121 is cooled, in particular kept cold by the method according to the invention and FIG. 7 illustrating the system 100 used during a condensation phase.

As detailed hereinbelow, the first embodiment and the second embodiment differ from one another essentially by the elements that constitute the supply unit 110, and more particularly by the elements that constitute the temperature raising portion 111 of this supply unit 110. Hence, elements that are common to these two embodiments and described hereinabove are not repeated in detail.

According to the first embodiment illustrated in FIGS. 2 to 4, the temperature raising portion 111 of the supply unit 110 comprises at least one heat exchanger 113, at least one expansion device 116 and at least one compression device 117.

The heat exchanger 113 comprises at least one first line 114 supplied by gas withdrawn in the liquid state from the tank 200 and at least one second line 115 supplied by gas withdrawn in the liquid state from the tank, the expansion device 116 being arranged between the tank 200 and the first line 114 of the heat exchanger 113. In turn, the compression device 117 is configured to increase the pressure of the gas flowing in the first line 114 of the heat exchanger 113 at least up to the atmospheric pressure.

The first line 114 is connected on the one hand to a first pump 300 arranged in the bottom of the tank 202 and on the other hand to the compression device 117 and the second line 115 is, in turn, connected on the one hand to a second pump 301 arranged in the bottom of the tank 202 and on the other hand also to the tank 200, and more specifically to the bottom of the tank 202 in which the gas in the liquid state is stored.

In other words, the first duct 102 extends between the first pump 300 and the first line 114 of the heat exchanger 113 and carries the expansion device 116, a seventh duct 108 extends between the second pump 301 and the second line 115 of the heat exchanger 113 and an eighth duct 109 extends, in turn, between the second line 115 and the bottom of the tank 202.

Alternatively, both of the first line and the second line of the heat exchanger may be supplied by the same pump, a bifurcation then being provided between this single pump and the first and second lines of the heat exchanger.

The expansion device 116 being arranged on the first duct 102, the gas withdrawn in the liquid state from the bottom of the tank 202 by the first pump 300 is expanded before reaching the first line 114 of the heat exchanger 113. In other words, the gas withdrawn from the tank in the liquid state by the first pump 300 enters the heat exchanger 113 at a pressure lower than the atmospheric pressure. The second pump 301 is configured to send the gas withdrawn in the liquid state from the bottom of the tank 202 directly into the second line 115 of the heat exchanger 113, i.e. the gas withdrawn in the liquid state from the tank 200 does not undergo any modification of temperature or pressure other than that related to the pumping itself before joining the second line 115 of the heat exchanger 113. Thus, the heat exchanger 113 is configured to perform a heat exchange between gas withdrawn from the tank in the liquid state and having undergone a decrease in its pressure and gas withdrawn from the tank in the liquid state and having undergone no pressure modification. Thus, the liquid gas that flows in the first line 114 is evaporated, whereas the liquid gas that flows in the second line 115 is sub-cooled before being returned to the bottom of the tank 202. In other words, according to this first embodiment of the invention, the temperature raising portion 111 of the supply unit 110 is more particularly a portion for evaporating at least a part of the gas withdrawn in the liquid state from the bottom of the tank 202.

In the presence of the second heat exchanger 145, the plant comprises a bypass channel 148 which extends between the seventh duct 108 and the eighth duct 109, such a bypass channel 148 then being arranged in parallel with the second line 115 of the heat exchanger 113. The flow of the gas in the liquid state withdrawn from the tank within the bypass channel 148 and/or within the second line 115 depends on a control member 149, which may herein be in the form of a three-way valve installed at the intersection between the bypass channel 148 and the seventh duct 108 or between this same bypass channel and the eighth duct 109.

During the condensation phase, the gas in the liquid state withdrawn from the tank 200 enters into this second heat exchanger 145 and passes through the second pass 147 of this second heat exchanger. The particularly low temperature of this gas in the liquid state, here about −163° C., is exploited to promote the condensation of the gas that enters the first pass 146 of this second heat exchanger 145.

The liquid gas flows in the first line 114 of the heat exchanger 113 at a pressure lower than the atmospheric pressure. As such, in order to ensure the flow of this liquid gas, the compression device 117 arranged between this heat exchanger 113 and the pressure raising portion 112 of the supply unit 110 is configured to return the gas that leaves this heat exchanger 113 to a pressure around the atmospheric pressure. For example, this compression device 117 is configured to compress the gas from 0.35 bar to 1 bar. The gas thus compressed is then able to join the pressure raising portion 112 of the supply unit 110 so that its pressure is raised up to the pressure compatible with the needs of the gas-consuming apparatus 101. The compression device 117 is arranged between the heat exchanger 113 and the third connection point 403 at the level of which the sixth duct 107 joins the supply unit 110.

As shown in FIG. 3, the supply unit 110 as described hereinabove and the gas present in the tank headspace 201 supply the gas-consuming apparatus 101. During this operating phase, the heat exchanger 121 is cooled or kept cold thanks to the above-described cooling device 130. In other words, the first pass 122 of the heat exchanger 121 is supplied with gas withdrawn in the second duct 103 with a flow rate comprised between 50 kg/h and 300 kg/h, advantageously equal to 200 kg/h. In turn, the second pass 123 is supplied with gas withdrawn in the gaseous state from the tank headspace 201 according to a flow rate comprised between 37.5 kg/h and 405 kg/h, advantageously 230 kg/h. In turn, the bypass duct 140 is supplied with the rest of the gas withdrawn in the gaseous state from the tank headspace 201.

Thus, the heat exchanger 121 is ready to be used as soon as necessary, for example as soon as the system 100 is in a situation in which the amount of gas in the gaseous state in the tank headspace 201 is larger than the amount of gas consumed by the gas-consuming apparatus 101. This situation is for example illustrated in FIG. 4.

When the amount of gas available in the gaseous state in the tank headspace 201 is larger than the amount of gas consumed by the gas-consuming apparatus 101, the condensation unit 120 liquefies the superfluous amount of gas so as to return it into the tank 200, thereby avoiding losing the gas compressed by the compression portion 112. In this condensation mode, the control member 131 is in an intermediate position or in an open position so as to supply the first pass 122 of the heat exchanger 121 with the superfluous gas, i.e. the gas in the gaseous state and compressed but which has not been consumed by the gas-consuming apparatus 101.

During this condensation step, within the heat exchanger 121, the gas not consumed by the gas-consuming apparatus 101 and with a flow rate higher than 300 kg/h is liquefied in order to be able to be returned into the tank 200 in the liquid state. The gas flow rate within the first pass 122 of the heat exchanger 121 during this condensation step is higher than 300 kg/h and lower than 3,000 kg/h.

The heat exchanger 121 is then the site of a heat exchange between the gas flowing in the first pass 122 and the gas flowing in the second pass 123 so as to cool the gas flowing in the first pass 122 on the one hand and to heat the gas flowing in the second pass 123 on the other hand. As a result, the gas flowing in the first pass 122 can then be returned to the second heat exchanger 145 where it condenses by exchange of calories between this gas which flows in the second pass 147 of the second heat exchanger 145 and the gas in the liquid state withdrawn from the tank 200 by means of the seventh duct 108 and the bypass channel 148. Afterwards, the gas flowing through the second pass 147 of the second heat exchanger 145 joins the tank 200 via the eighth duct 109.

In particular, FIG. 4 illustrates a situation in which the flow rate regulation device 141 is in its second open position so that no gas flows in the bypass duct 140.

According to the example illustrated in FIG. 4, the pumps 300, 301 as well as the compression device 117 are stopped. In other words, the temperature raising portion 111 of the supply unit 110 is stopped. Indeed, the amount of gas naturally present in the tank headspace 201 being enough to supply the gas-consuming apparatuses 101, it is no longer necessary to evaporate liquid gas in order to carry out this supply. The stoppage of this temperature raising portion 111 then makes it possible to reduce the operating costs of the system 100 according to the invention.

The supply system 100 according to the second embodiment illustrated in FIGS. 5 to 7 differs from the system 100 according to the first embodiment in particular by the elements that constitute the temperature raising portion 111' of the supply unit 110. Also, the second illustrated embodiment differs from the illustrated first embodiment in that the system 100 comprises a refrigerant fluid circuit thermally associated with the supply unit 110.

According to the second embodiment, the refrigerant fluid circuit 500 comprises at least one first heat exchanger 113', a compression apparatus 501 adapted to increase a pressure of the refrigerant fluid flowing therethrough, at least one second heat exchanger 125 and at least one expansion apparatus 502 adapted to reduce a pressure of the refrigerant fluid. In turn, the pressure raising portion 111' comprises at least the first heat exchanger 113'. The first heat exchanger 113' of the temperature raising portion 111' comprises at least one first line 114' supplied by gas withdrawn in the gaseous state from the tank headspace 201 and at least one second line 115' supplied by the refrigerant fluid in the gaseous state and compressed by the compression apparatus 501. Thus, unlike the first embodiment, the first duct 102' extends between the tank headspace 201 and the first line 114' of the heat exchanger 113'.

The refrigerant fluid is selected so that the heat exchange performed within the heat exchanger 113' results in an increase in the temperature of the gas flowing in the first line 114' of this heat exchanger 113'.

In turn, the second heat exchanger 125 comprises at least one first pass 126 supplied by gas withdrawn in the liquid state from the bottom of the tank 202 and at least one second pass 127 supplied by expanded refrigerant fluid, i.e. this second heat exchanger 125 is arranged immediately downstream of the expansion apparatus 502 on the refrigerant fluid circuit 500. Thus, the first pass 126 of the second heat exchanger 125 is supplied by a pump 303 arranged in the bottom of the tank 202.

In turn, the second pass 147 of the second heat exchanger 145 is connected to the first pass 126 of the second heat exchanger 125. In this way, the gas in the liquid state which has been cooled by the second heat exchanger 125 promotes the condensation of the gas flowing through the first pass 122 of the first heat exchanger 121.

The refrigerant fluid that circulates in the refrigerant fluid circuit 500 is circulated by the compression apparatus 501 in which it undergoes an increase in its pressure. Hence, it leaves this compression apparatus 501 in the gaseous state and at high pressure, then it joins the first heat exchanger 113' in which it transfers calories to the gas flowing in the first line 114' of this heat exchanger 113'. Thus, the refrigerant fluid leaves the second line 115' of the heat exchanger 113' in the two-phase or liquid state and joins the expansion apparatus 502 in which it undergoes a decrease in its pressure. The refrigerant fluid then joins the second heat exchanger 125 in which it picks up calories from the gas withdrawn in the liquid state from the bottom of the tank 202. The result of the heat exchange performed in the second heat exchanger 125 is an evaporation of the refrigerant fluid, which could then initiate a new thermodynamic cycle, and simultaneously a sub-cooling of the gas withdrawn in the liquid state from the bottom of the tank 202. The sub-cooled gas is sent back to the tank 200 after having been used within the second heat exchanger 145 to liquefy the gas coming from the first pass 122 of the first heat exchanger 121.

According to the example illustrated here, the first heat exchanger 113' advantageously comprises a third pass 119' supplied with refrigerant fluid. In particular, this third pass 119' is interposed, on the refrigerant circuit 500, between the second pass 127 of the second heat exchanger 125 and the compression apparatus 501. Thus, the second line 115' and the third pass 119 form an inner heat exchanger of the refrigerant fluid circuit 500 which makes it possible to preheat the gas in the gaseous state which leaves the second pass 127 of the second heat exchanger 125 before the latter joins the compression apparatus 501 and to pre-cool the gas in the gaseous state which leaves the compression apparatus 501 before the latter joins the expansion apparatus 502. In other words, it should be understood that the presence of this third pass 119' in this first heat exchanger 113' improves the overall thermal performance of the refrigerant fluid circuit 500.

It should also be noted that, compared to the first embodiment, the temperature raising portion 111' according to the second embodiment is free of the compression device.

Finally, the supply system 100 according to the second embodiment differs from the supply system 100 according to the first embodiment in that it comprises a forced evaporation line 128 which extends from a pump 302 arranged in the bottom of the tank 202, up to the third connection point 403 located upstream of the pressure raising portion 112. As schematically illustrated in FIG. 6, a vaporizer 129 is arranged on this forced evaporation line 128. This vaporizer 129 is configured to enable the evaporation of gas withdrawn in the liquid state by the pump 302 arranged in the bottom of the tank 202. As detailed hereinbelow, this forced evaporation line 128 is particularly useful in a situation where the gas in the vapor state present in the tank headspace is not enough for the needs of the gas-consuming apparatus 101.

According to a variant of the second embodiment not illustrated herein, the pump 302 may be a high-pressure pump, i.e. a pump configured to increase the pressure of the liquid it sucks. In this case, this high-pressure pump may for example be configured to increase the pressure of the withdrawn gas up to a pressure comprised between 1 bar and 400 bar, advantageously between 1 bar and 17 bar, still more advantageously, between 6 bar and 17 bar. According to this alternative, the evaporation line 128 then extends between the high-pressure pump and the second duct 103, i.e. a point located downstream of the pressure raising portion of the supply unit.

FIGS. 6 and 7 illustrate the supply system 100 according to the second embodiment of the invention, respectively implemented during a step of cooling the heat exchanger and during use of the condensation unit to liquefy the gas, at least partially.

In the situation illustrated in FIG. 6, the amount of gas present in the tank headspace 201 is not enough to supply the gas-consuming apparatus 101, so that the forced evaporation line 128 is activated or the supply unit 110 is activated. FIG. 6 illustrates just the activation of the forced evaporation line 128. Thus, gas is withdrawn in the liquid state from the bottom of the tank 202 and evaporated by the vaporizer 129 before joining the pressure raising portion of the supply unit 110 to finally supply the gas-consuming apparatus 101.

In a similar manner to what has been described hereinabove with reference to the first embodiment, a portion of the gas flowing in the second duct 103 is derived by the cooling device 130 to supply the first pass 122 of the heat exchanger 121 at a flow rate comprised between 50 kg/h and 300 kg/h, advantageously equal to 200 kg/h, so that the heat exchanger 121 can be quickly operated when the condensation step is implemented. Similarly, the bypass duct 140 of the second pass 123 of the heat exchanger 121 is supplied so that the gas that flows in this second pass 123 of the heat exchanger 121 has a flow rate comprised between 37.5 kg/h and 405 kg/h, advantageously a flow rate equal to 230 kg/h.

Similarly to what has been described before, the implementation of the system during the cooling step illustrated in FIG. 6 is identical, or almost identical, to the implementation of the system 100 given with reference to FIG. 3.

In the situation illustrated in FIG. 7, the forced evaporation line 128 is stopped and the gas-consuming apparatus 101 is supplied only by gas withdrawn in the gaseous state from the tank headspace 201. In this situation, the condensation unit 120 condenses the gas not consumed by the gas-consuming apparatus 101. To this end, the flow rate regulation device 141 is in its second open position, i.e. all of the gas withdrawn thanks to the third duct 104 is sent towards the second pass 123 of this heat exchanger 121.

Finally, FIG. 8 is a cut-away view of a ship 70 which comprises the tank 200 containing the gas in the liquid state and in the gaseous state, this tank 200 having a prismatic general shape and being mounted in a double hull 72 of the ship. This tank 200 may be part of an LNG carrier but it may also be a reservoir when the gas is used as fuel for the fuel-consuming apparatus.

The wall of the tank 200 has a primary sealing membrane intended to be in contact with the gas in the liquid state contained in the tank, a secondary sealing membrane arranged between the primary sealing membrane and the double hull 72 of the ship 70, and two insulating barriers respectively arranged between the primary sealing membrane and the secondary sealing membrane and between the secondary sealing membrane and the double hull 72.

Loading and/or unloading pipes 73 arranged on the upper deck of the ship may be connected, by means of suitable connectors, to a maritime or port terminal to transfer the cargo of natural gas in the liquid state from or to the tank 200.

FIG. 8 also shows an example of a maritime terminal having a loading and/or unloading station 75, an underwater duct 76, an onshore or port facility 77 and ducts 74, 78. The loading and unloading station 75 enables loading and/or unloading of the ship 70 from or to the onshore facility 77. The latter includes liquefied gas storage tanks 80 and connecting ducts 81 connected by the underwater duct 76 to the loading and/or unloading pipes 73. The underwater duct 76 enables the transfer of the liquefied gas between the loading or unloading station 75 and the onshore facility 77 over a long distance, for example five km, which makes it possible to keep the ship 70 a long distance from the coast during loading and/or unloading operations.

In order to generate the pressure necessary for the transfer of the liquefied gas, one or more unloading pumps carried by a loading and/or unloading tower of the tank 200 and/or pumps equipping the onshore facility 77 and/or pumps equipping the loading and unloading station 75 are implemented.

Thus, the present invention provides a gas supply system which makes it possible to supply the gas-consuming devices present on a ship with gas that is naturally evaporated, with forcibly evaporated liquid gas and also to condense the naturally evaporated gas if the latter was in too large an amount relative to the energy demand of the gas-consuming apparatus(es) of the ship, this condensation step being preceded by a step of cooling the heat exchanger of the condensation unit, thereby enabling an action of the condensation unit over a reduced time period compared to the prior art.

The present invention cannot, however, be limited to the means and configurations described and shown here, and it also extends to any equivalent means or configuration as well as to any combination technically using such means.

The invention claimed is:

1. A method for supplying gas to a gas-consuming apparatus provided on a ship comprising a tank containing the gas in a liquid state and in a gaseous state, the method comprising:

supplying the gas-consuming apparatus with gas withdrawn in the gaseous state from the tank by a supply unit, condensing at least a part of the gas withdrawn in the gaseous state from the tank by a condensation unit comprising at least one heat exchanger which comprises at least one first pass and one second pass, said heat exchanger being configured to perform a heat exchange between gas withdrawn between the supply unit and the gas-consuming apparatus and flowing in the first pass and gas flowing between the tank and the supply unit and flowing in the second pass, and cooling the heat exchanger by a flow of gas in the first pass and in the second pass of the heat exchanger, the cooling being implemented prior to the condensing and at least partially simultaneously with the supplying.

2. The supply method according to claim 1, wherein the cooling comprises controlling a flow rate of gas flowing through the first pass of the heat exchanger to a ratio comprised between 2% and 12% of a flow rate of the gas withdrawn in the gaseous state from the tank during the supplying.

3. The supply method according to claim 1, wherein the cooling comprises controlling a flow rate of gas flowing through the second pass of the heat exchanger during the cooling to a ratio comprised between 75% and 135% of a flow rate of the gas flowing through the first pass of the heat exchanger.

4. The supply method according to claim 1, wherein the cooling comprises controlling a flow rate of gas flowing through the first pass of the heat exchanger during the cooling to a value comprised between 50 kg/h and 300 kg/h.

5. The supply method according to claim 1, wherein a flow rate of gas flowing through the first pass of the heat exchanger during the cooling is comprised between 3% and 20% of a flow rate of gas flowing through the first pass of the heat exchanger during the condensing.

6. The supply method according to claim 2, wherein the gas flowing through the first pass of the heat exchanger during the cooling joins the supply unit.

7. The supply method according to claim 1, wherein the cooling the heat exchanger leads to the heat exchanger passing from a positive Celsius temperature to a negative Celsius temperature.

8. The supply method according to claim 1, wherein the cooling the heat exchanger includes keeping the heat exchanger cold leading to the heat exchanger passing from a first negative Celsius temperature to a second negative Celsius temperature.

9. A system for performing the method according to claim 1, the system comprising:

a tank for at least one of storing and transporting gas in a liquid state and in a gaseous state, intended to contain gas, a supply unit for the gas-consuming apparatus configured to withdraw gas from the tank and raise a pressure of the gas to supply the gas-consuming apparatus, a condensation unit comprising at least one heat exchanger which includes a first pass and a second pass, the condensation unit being configured so that gas withdrawn between the supply unit and the gas-consuming apparatus flows through the first pass, whereas gas flowing between the tank and the supply unit flows through the second pass, and a device for cooling the heat exchanger comprising at least one control member configured to control the flow rate of the gas flowing through the first pass and a device for controlling the temperature of the heat exchanger, the heat exchanger being cooled by a flow of gas in the first pass and in the second pass.

10. The gas supply system according to claim 9, wherein the device for controlling the temperature of the heat exchanger comprises at least one duct for bypassing the second pass of the heat exchanger.

11. The gas supply system according to claim 10, wherein the device for controlling the temperature of the heat exchanger comprises at least one device for regulating the flow rate of gas flowing through the bypass duct and a sensor able to measure or determine a temperature of the gas at an inlet of the first pass of the heat exchanger, the flow rate of gas flowing through the bypass duct depending at least on the temperature of the gas determined at the inlet of the first pass of the heat exchanger.

12. The gas supply system according to claim 11, wherein the sensor is able to measure or determine a temperature of the gas at an outlet of the second pass of the heat exchanger, the flow rate of gas flowing through the bypass duct depending on the temperature of the gas at the outlet of the second pass of the heat exchanger.

13. The gas supply system according to claim 9, wherein the condensation unit comprising at least the heat exchanger, hereinafter referred to as the first heat exchanger, which includes the first pass and the second pass, also comprises a second heat exchanger which is a site of a heat exchange between gas withdrawn in the liquid state from the tank and the gas that comes from the first pass of the first heat exchanger.

14. The gas supply system according to claim 9, wherein the supply unit comprises at least one portion for raising the temperature of gas withdrawn in the liquid state from the tank and at least one portion for raising the pressure of the gas to supply the gas-consuming apparatus.

15. The gas supply system according to claim 14, wherein the temperature raising portion of the supply unit comprises another heat exchanger and at least one compression device, the compression device being arranged between the another heat exchanger and the pressure raising portion, the another heat exchanger comprising at least one first line supplied with gas withdrawn in the liquid state from the tank and at least one second line supplied with gas withdrawn in the liquid state from the tank, at least one expansion device being arranged between the tank and the first line of the another heat exchanger.

16. A ship for transporting gas in the liquid state, comprising at least one gas supply system according to claim 9.

17. A system for loading or unloading a gas in the liquid state which combines at least one onshore or port facility and at least one ship for transporting gas in the liquid state according to claim 16.

18. A method for loading or unloading a gas in the liquid state for a ship for transporting gas according to claim 16, during which the gas in the liquid state is conveyed through pipes from or towards a floating or onshore storage facility towards or from the tank of the ship.

* * * * *